US006007414A

United States Patent [19]

Tsai

[11] Patent Number: 6,007,414

[45] Date of Patent: Dec. 28, 1999

[54] POLISHING MACHINE

[76] Inventor: James Tsai, 103, Ta-Ming 1rd., Tung Pao Tsun, Tan Tzu Hsiang, Taichung Hsien, Taiwan

[21] Appl. No.: 09/076,781

[22] Filed: May 13, 1998

[51] Int. Cl.[6] ..... B24B 23/00

[52] U.S. Cl. ..... 451/351; 451/344

[58] Field of Search ..... 451/164, 344, 451/356

[56] References Cited

U.S. PATENT DOCUMENTS

| | | | |
|---|---|---|---|
| 2,054,458 | 9/1936 | Arge et al. | 451/356 |
| 2,620,775 | 12/1952 | Champayne | 451/356 X |
| 2,635,396 | 4/1953 | Johnson | 451/356 |
| 2,706,368 | 4/1955 | Randolph | 451/356 |
| 5,179,807 | 1/1993 | Gupton | 451/344 X |
| 5,453,040 | 9/1995 | Schaal et al. | 451/344 |

*Primary Examiner*—Robert A. Rose
*Assistant Examiner*—Anthony Ojini
*Attorney, Agent, or Firm*—Browdy and Neimark

[57] ABSTRACT

A polishing machine consists of a housing to which a handle is fastened pivotally. A motor is mounted in the interior of the housing such that an output end of the motor is fastened with a linking mechanism. Two reciprocating members are fastened pivotally with the housing such that the reciprocating members are actuated by the linking mechanism to engage in a linear reciprocating motion. Two rubbing members are fastened respectively with the two reciprocating members such that the rubbing members are capable of rubbing a surface in a linear reciprocating manner.

6 Claims, 2 Drawing Sheets

POLISHING MACHINE

FIELD OF THE INVENTION

The present invention relates generally to a cleaning equipment, and more particularly to a polishing machine capable of rubbing a surface in a linear reciprocating manner.

BACKGROUND OF THE INVENTION

The conventional polishing machine is generally composed of a rubbing device capable of rubbing a floor surface, a car body surface, a furniture, etc. in a circular pattern. The circular rubbing motion of the conventional polishing machine is prone to leave irregular traces on a rubbed surface.

SUMMARY OF THE INVENTION

The primary objective of the present invention is to provide a polishing machine capable of rubbing a surface in a linear reciprocating motion without leaving the irregular traces on the surface.

In keeping with the principle of the present invention, the foregoing objective of the present invention is attained by a polishing machine consisting of a housing, a handle fastened at one end thereof with the housing, a motor mounted in the housing, a linking mechanism mounted on an output end of the motor and driven by the motor, two reciprocating members fastened pivotally with the housing such that the two reciprocating members can be actuated by the linking mechanism to engage in a linear reciprocating motion, and two rubbing members fastened with the two reciprocating members to rub a surface in a linear path and in an alternate manner.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
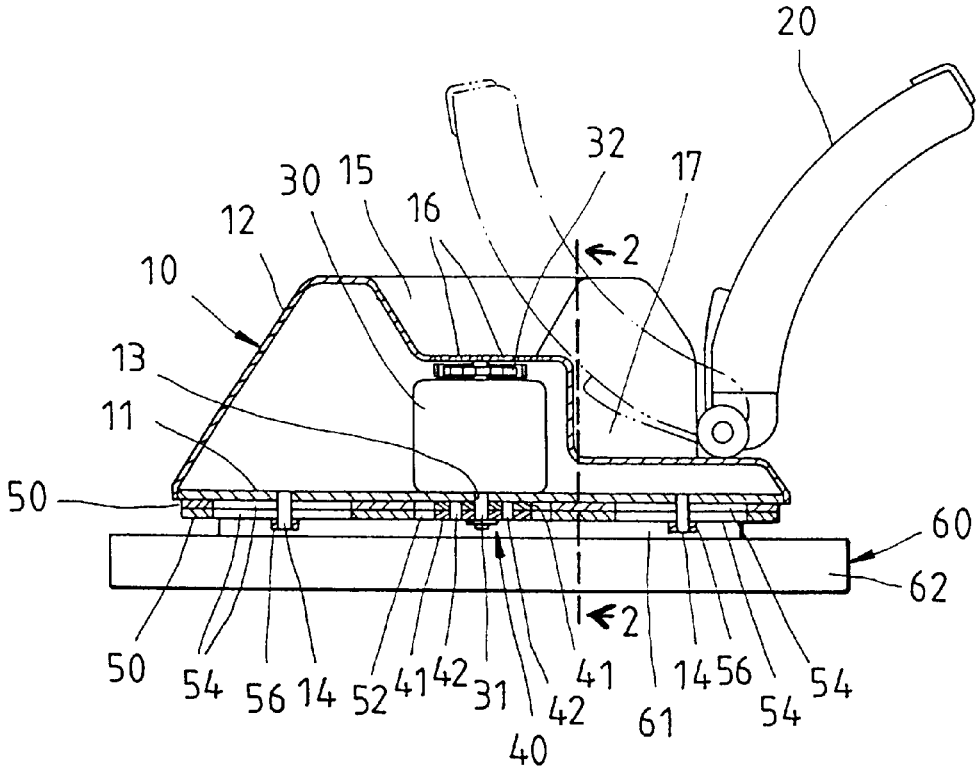
FIG. 1 shows a sectional view of the preferred embodiment of the present invention.
Figure 2:
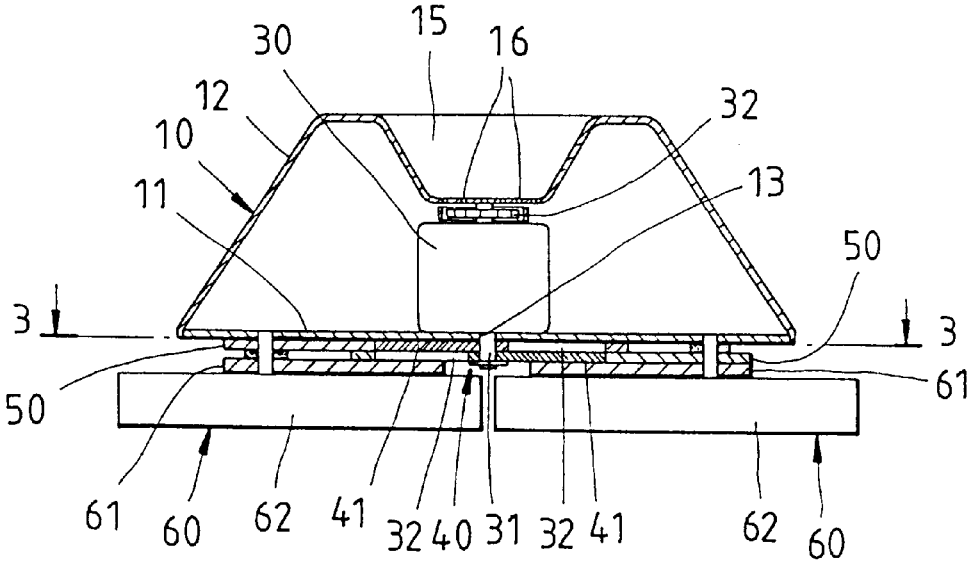
FIG. 2 shows a sectional view of a portion taken alone the direction indicated by a line 2—2 as shown in FIG. 1.

As shown in FIGS. 1–4, a polishing machine embodied in the present invention is composed of a housing 10, a handle 20, a motor 30, a linking mechanism 40, two reciprocating members 50, and two rubbing members 60.

The housing 10 is made up of a round bottom plate 11 and a bowl-shaped housing shield 12 joined with the bottom plate 11. The bottom plate 11 is provided at the center thereof with a through hole 13, and in the underside thereof with two locating rods 14 extending therefrom such that the two locating rods 14 are opposite in location to each other. The housing shield 12 is provided at the center of the top thereof with a cavity 15 which is in turn provided in the underside thereof with a plurality of cooling holes 16. The cavity 15 is provided with an indentation 17 extending therefrom.

The handle 20 is fastened pivotally with a side of the housing 10 such that the handle 20 is corresponding in location to the indentation 17. The handle 20 can be located at a position indicated by a solid line position in FIG. 1 so as to facilitate the pushing and the pulling of the polishing machine of the present invention. The handle 20 can be folded inward at the indentation 17, as shown by an imaginary line position in FIG. 1, for saving storage space.

The motor 30 is mounted at the center of the interior of the housing 10 such that the rotary shaft 31 of the motor 30 is extended outside the housing 10 via the through hole 13 of the bottom plate 11. A cooling fan 32 is mounted over the motor 30 such that the cooling fan 32 is driven by the rotary shaft 31. The hot air in the housing 10 is dissipated through the cooling holes 16.

Figure 3:
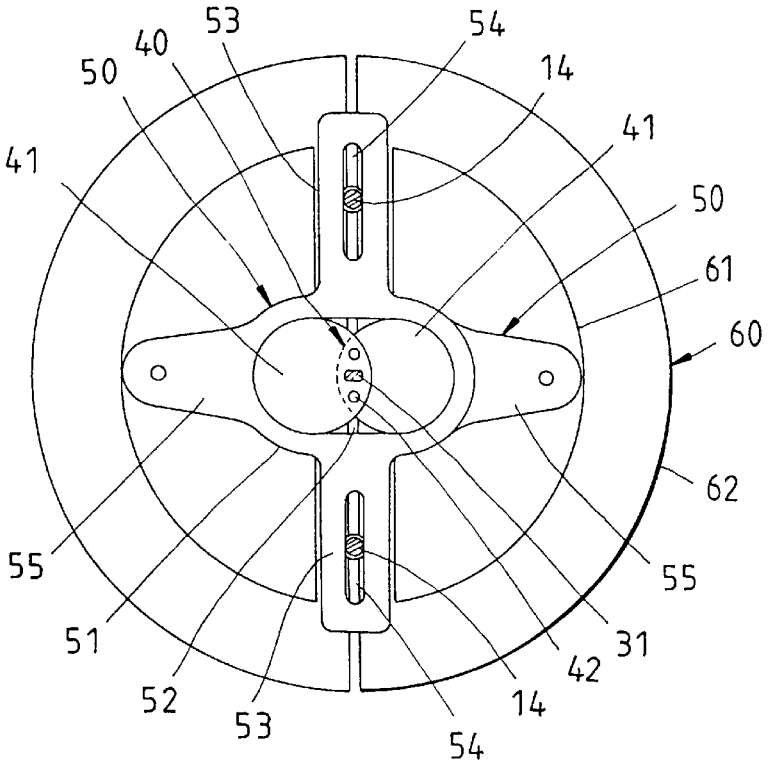
FIG. 3 shows a sectional view of a portion taken along the direction indicated by a line 3—3 as shown in FIG. 2.

The linking mechanism 40 consists of two eccentric members 41 of a round platelike construction and fastened eccentrically with the rotary shaft 31 of the motor 30 such that the two eccentric members 41 are partially stacked, and that the rotary shaft 31 is located at the midpoint of the connection line of the circle centers of the two eccentric member 41, as shown in FIG. 3. The two eccentric members 41 are secured by two pins 42 which are inserted into the stacked portion. The upper eccentric member 41 is slightly attached to the underside of the bottom plate 11 of the housing 10.

The two reciprocating members 50 are of a sheetlike construction and are equal in thickness to the eccentric member 41. The reciprocating members 50 have an oblong main portion 51, which is provided at the center thereof with an oblong connection hole 52, as shown in FIG. 3. The width of the short axial direction of the oblong connection hole 52 is about equal to the diameter of the eccentric members 41, whereas the width of the longitudinal axial direction of the oblong connection hole 52 is about equal to the sum of the lengths of the two eccentric members 41. The main portion 51 is provided respectively in two long sides thereof with an arm portion 53 extending therefrom and having a long slot 54. The longitudinal axis of the arm portion 53 is perpendicular to the longitudinal axis of the connection hole 52. The main portion 51 is provided in a short side thereof with a connection portion 55 extending therefrom. The two reciprocating members 50 is located at the bottom of the housing 10 such that they are superimposed, and that the upper reciprocating member 50 is slightly attached to the underside of the bottom plate 11 of the housing 10. The main portions 51 and the arm portions 53 of the two reciprocating members 50 are generally superimposed. The connection portions 55 face different sides. The two long slots 54 of the two reciprocating members 50 are engaged with the two locating rods 14 of the housing 10. The two locating rods 14 are provided respectively at the bottom end thereof with an arresting member 56, which is slightly attached to the underside of the lower reciprocating member 50. The two reciprocating members 50 are capable of a limited linear displacement along the long slots 54. The two eccentric members 41 of the linking mechanism 40 are located respectively in the connection holes 52 of the two reciprocating members 50 such that the peripheries of the eccentric members 41 are in contact with the hole walls of the connection holes 52.

The two rubbing members 60 have a semicircular base block 61 which is provided in the underside thereof with a felt 62 for rubbing a surface. The two rubbing members 60 are fastened respectively with the connection portions 55 of the two reciprocating members 50 such that each rubbing member 60 is capable of being actuated by the corresponding reciprocating member 50. The two rubbing members 60 are arranged symmetrically and circularly.

Figure 4:
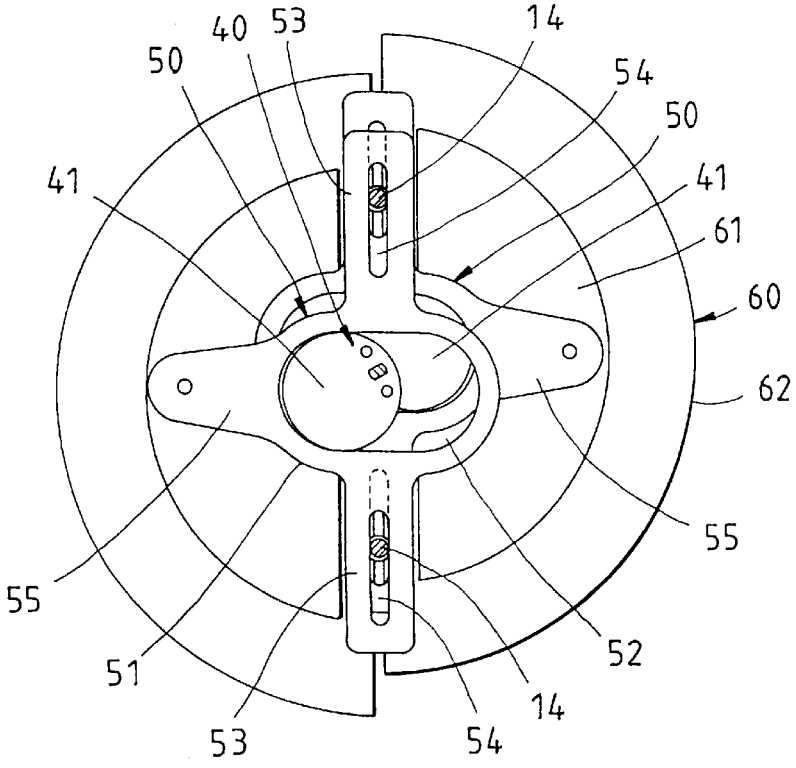
FIG. 4 shows a sectional view similar to FIG. 3 to illustrate the present invention at work.

As the motor 30 is started, the two eccentric members 41 of the linking mechanism 40 are driven by the rotary shaft 31 of the motor 30 to turn eccentrically, as shown in FIGS. 3 and 4. In light of the periphery of the eccentric member 41 being partially attached to the hole wall of the connection hole 52 of the reciprocating member 50, the corresponding reciprocating member 50 is pushed to engage in a linear reciprocating motion at the time when one of the two reciprocating members 50 is turning eccentrically. The rubbing member 60 is thus actuated by the reciprocating member 50. The eccentric rotations of the two eccentric members 41 are brought about such that the two eccentric members 41 are kept at 180-degree angle. As a result, the two reciprocating members 50 and the two rubbing members 60 are alternately engaged in motion in opposite directions. In other words, when one of the two reciprocating members 50 moves forward, another one of the two reciprocating members 50 moves backward at the same time.

What is claimed is:

1. A polishing machine comprising:

a housing;

a handle fastened at one end thereof with said housing;

a motor mounted in said housing;

a linking mechanism mounted on an output end of said motor and driven by said motor;

two reciprocating members fastened to said housing and actuated by said linking mechanism to engage in a linear reciprocating motion in opposite directions; and two rubbing members fastened respectively with said two reciprocating members for rubbing a surface at such time when said reciprocating members are in motion;

wherein each of said two reciprocating members has a main portion; an oblong connection hole being located in said main portion, said linking mechanism being slideably engaged in said oblong connection hole, said main portion being provided respectively on two opposite sides thereof with an arm portion extending therefrom and having a long slot and a longitudinal axis perpendicular to a longitudinal axis of said oblong connection hole; and wherein said housing has two locating rods which are engaged with said long slots of said reciprocating members.

2. The polishing machine as defined in claim 1, wherein said linking mechanism has two eccentric members of a round shape fastened with said output end of said motor such that said two eccentric members are driven by said motor to turn eccentrically; wherein said reciprocating members are fastened pivotally with said housing such that said reciprocating members are capable of only a linear motion and are provided with said oblong connection hole having a longitudinal axis perpendicular to a direction in which said reciprocating members move said oblong connection hole having a hole wall in contact with a periphery of each of said eccentric members such that said reciprocating members are pushed to engage in a linear reciprocating motion at the time when said eccentric member is engaged in an eccentric rotation.

3. The polishing machine as defined in claim 1, wherein each of said two eccentric members of said linking mechanism is of a round platelike construction; wherein said two eccentric members are mounted on a rotary shaft of said motor such that said eccentric members are superimposed, and that said rotary shaft is located at a midpoint of a line connecting two circle centers of said two eccentric members; and wherein said reciprocating members are of a sheetlike construction and are equal in thickness to said eccentric members, said two reciprocating members being superimposed.

4. The polishing machine as defined in claim 1, wherein each of said two rubbing members respectively has a semicircular base block fastened to each of said two reciprocating members, said base block provided with a rubbing felt fastened therewith.

5. The polishing machine as defined in claim 1, wherein said handle is fastened pivotally at one end thereof with said housing such that said handle can be folded and located.

6. The polishing machine as defined in claim 1, wherein said locating rods are respectively provided at one end thereof with an arresting member slideably engaged with an outer reciprocating member of said reciprocating members, an inner reciprocating member of said reciprocating members being slideably engaged to said housing, each of said reciprocating members being linearly displaceable along said long slots.

* * * * *